US007436385B2

(12) United States Patent
Kim et al.

(10) Patent No.: US 7,436,385 B2
(45) Date of Patent: Oct. 14, 2008

(54) ANALOG BUFFER AND DRIVING METHOD THEREOF, LIQUID CRYSTAL DISPLAY APPARATUS USING THE SAME AND DRIVING METHOD THEREOF

(75) Inventors: Kee Jong Kim, Seoul (KR); Juhn Suk Yoo, Seoul (KR)

(73) Assignee: LG Display Co., Ltd., Seoul (KR)

( * ) Notice: Subject to any disclaimer, the term of this patent is extended or adjusted under 35 U.S.C. 154(b) by 753 days.

(21) Appl. No.: 10/879,346

(22) Filed: Jun. 30, 2004

(65) Prior Publication Data

US 2005/0007325 A1 Jan. 13, 2005

(30) Foreign Application Priority Data

Jul. 8, 2003 (KR) ..... 10-2003-0046067

(51) Int. Cl.
*G09G 3/36* (2006.01)

(52) U.S. Cl. ..... 345/98

(58) Field of Classification Search ..... 345/98–100, 345/87, 204; 341/144, 145, 150
See application file for complete search history.

(56) References Cited

U.S. PATENT DOCUMENTS 6,498,596 B1 * 12/2002 Nakamura et al. ..... 345/98
7,136,058 B2 * 11/2006 Nakamura et al. ..... 345/211
2002/0175722 A1 * 11/2002 Mano et al. ..... 327/156
2003/0030617 A1 * 2/2003 Han et al. ..... 345/98

FOREIGN PATENT DOCUMENTS

| | | |
|---|---|---|
| JP | 11-218737 | 8/1999 |
| KR | 92-7321 U | 4/1992 |
| KR | 2001-0066695 | 7/2001 |
| WO | WO 9513652 A1 * | 5/1995 |

* cited by examiner

*Primary Examiner*—Amr Awad
*Assistant Examiner*—Stephen G Sherman
(74) *Attorney, Agent, or Firm*—Morgan, Lewis & Bockius LLP

(57) ABSTRACT

An analog buffer for buffering an input voltage to an output line is provided. The analog buffer includes a constant current source and a comparator. The constant current source supplies a constant current to the output line, and the comparator compares a voltage charged on the output line with the input voltage to turn-off the constant current source if it is determined that the voltage charged on the output line corresponding to the input voltage is buffered to the output line.

18 Claims, 18 Drawing Sheets

ANALOG BUFFER AND DRIVING METHOD THEREOF, LIQUID CRYSTAL DISPLAY APPARATUS USING THE SAME AND DRIVING METHOD THEREOF

This application claims the benefit of Korean Patent Application No. P2003-46067 filed in Korea on Jul. 8, 2003, which is hereby incorporated by reference.

BACKGROUND OF THE INVENTION

1. Field of the Invention

The present invention relates to an analog buffer, and more particularly, to an analog buffer and a method of fabricating the same that are capable of reducing power consumption.

2. Description of the Related Art

A liquid crystal display device displays a picture by controlling the light transmittance of a liquid crystal material having a dielectric anisotropy using an electric field. To this end, the liquid crystal display device includes a liquid crystal panel having a pixel matrix and a drive circuit for driving the liquid crystal panel. As shown in FIG. 1, the liquid crystal display device includes a liquid crystal panel 2*r* having a pixel matrix, a gate driver 4*r* for driving gate lines GL1 to GLn of the liquid crystal panel 2*r*, a data driver 6*r* for driving data lines DL1 to DLm of the liquid crystal panel 2*r* and a timing controller 8*r* for controlling a driving timing of the gate driver 4*r* and the data driver 6*r*. The liquid crystal panel 2*r* includes the pixel matrix having pixels 12*r* formed at each area defined by each intersection of gate lines GL and data lines DL. Each of the pixels 12*r* has a liquid crystal cell Clc that controls light transmittance according to a pixel signal and a thin film transistor TFT that drives the liquid crystal cell Clc.

When the thin film transistor TFT receives a gate driving signal from the gate line GL, i.e., a gate high voltage VGH, the thin film transistor TFT is turned-on to supply a video signal from the data line DL to the liquid crystal cell Clc. Moreover, when the thin film transistor TFT receives a gate low voltage VGL from the gate line GL, the thin film transistor TFT is turned-off, thereby maintaining a video signal charged to the liquid crystal cell Clc. The liquid crystal cell Clc can be equivalently represented as a capacitor. The liquid crystal cell Clc includes a common electrode and a pixel electrode connected to the TFT wherein a liquid crystal material is inserted between the common electrode and the pixel electrode. The liquid crystal cell Clc further includes a storage capacitor (not shown) for stably maintaining the video signal charged thereto until a next video signal is charged. The liquid crystal cell Clc varies the arrangement of liquid crystal materials with a dielectric anisotropy in accordance with the video signal charged through the TFT, thereby controlling the light transmittance. Accordingly, the liquid crystal cell Clc represents gray levels.

The gate driver 4*r* shifts a gate start pulse (GSP) from a timing controller 8*r* in accordance with a gate shift clock (GSC) to sequentially supply a scan pulse of the gate high voltage VGH to the gate lines GL1 to GLm. Moreover, the gate driver 4*r* supplies the gate low voltage VGL during a scan pulse of the gate high voltage VGH is not supplied to the gate lines GL1 to GLm.

The data driver 6*r* shifts a source start pulse (SSP) from the timing controller 8*r* in accordance with a source shift clock (SSC), thereby generating a sampling signal. Further, the data driver 6*r* latches a video data RGB input by the signal SSC in accordance with the sampling signal, and then supplies the latched video data by a line unit in response to a source output enable (SOE) signal. Then, the data driver 6*r* converts digital video data RGB supplied by the line unit to analog video signals using gamma voltages, which are different each other, supplied from a gamma voltage, thereby supplying the analog video signals to the data lines DL1 to DLm. At this time, the data driver 6*r* determines the polarity of the video signals in response to the polarity controlling signal (POL) from the timing controller 8*r* at the time of the conversion of the digital video data to the analog video signals.

The timing controller 8*r* generates the signals GSP and GSC for controlling the gate driver 4*r* and also generates a source start signal SSP, a source shift clock SSC, a source output enable signal SOE, and the signal POL signals for controlling the data driver 6*r*. More specifically, the timing controller 8*r* generates a variety of control signals such as the GSP, GSC, GOE, SSP, SSC, SOE, POL and the like using a data enable DE signal representing an effective data interval, a horizontal synchronizing signal Hsync, a vertical synchronizing signal Vsync and a dot clock (DCLK) to determine the transmission timing of the pixel data RGB.

In the liquid crystal display device configured as described above, the data driver 6*r* includes an analog buffer for preventing a distortion of the video signal supplied to the data line in accordance with an amount of RC load on the data line. The gate driver 4*r* also includes an analog buffer for preventing a distortion of the gate driving signal supplied to the gate line in accordance with an amount of RC load on the gate line. In general, an amplifier (OP-AMP) is mainly used for the analog buffer. However, a scheme having a simplified circuit configuration using an inverter has been recently proposed.

For instance, a paper "AMLCD '02", PP21-24, published by Toshiba describes an analog buffer which employs three inverters as shown in FIG. 2. The analog buffer shown in FIG. 2 includes: first to third inverters 3, 5 and 7 which are connected in series between an input line and an output line; first to third capacitors 2, 4 and 6 which are connected in series to input terminals of the first to the third inverter 3, 5 and 7, respectively; a first switch 1 connected between the input line and the first capacitor 2; second to fourth switches 8, 9 and 10 which are connected between input terminals and output terminals of the first to the third inverters 3, 5 and 7, respectively; and a fifth switch 11 connected between the input line and the output line.

FIGS. 3A and 3B are a driving waveform diagram and a power consumption waveform diagram for the analog buffer shown in FIG. 2, respectively.

The second to the fourth switches 8, 9 and 10 of FIG. 2 for initializing the first to the third inverters 3, 5 and 7 are turned-on by a reset pulse RESET as shown in FIG. 3A. Accordingly, the input and output terminals of the first to the third inverters 3, 5 and 7 are shorted so that the first to the third inverters 3, 5 and 7 are initialized with a value of an intermediate voltage Vm of a power source. Also, the first switch 1 for supplying an input voltage Vin is turned-on to supply the input voltage Vin, as shown in FIG. 3A, to the first capacitor 2. Accordingly, a difference voltage of the input voltage Vin and the intermediate voltage Vm applied to the initialized first inverter 3 is charged in the first capacitor 2. Subsequently, the fifth switch 11 used for a feedback is turned-on so that the output voltage Vout corresponding to the input voltage Vin is monitored in the output line.

Since the analog buffer is organized with only the inverters, it has a simple configuration as compared with a typical analog buffer implemented using the amplifiers OPAMP. However, in the analog buffer shown in FIG. 2, the first to the third inverters 3, 5 and 7 should maintain the intermediate voltage Vm after charging the input voltage Vin in the output line. Accordingly, there always exists a stand-by current caused by the first to the third inverters 3, 5 and 7. As a result, a power of about −80 μW (microwatts) is dissipated after charging the input voltage Vin, as shown in FIG. 3B. The power consumption is significantly increased with increasing numbers of inverters.

SUMMARY OF THE INVENTION

Accordingly, the present invention is directed to a analog buffer and driving method thereof, liquid crystal display apparatus using the same and driving method thereof that substantially obviates one or more of the problems due to limitations and disadvantages of the related art.

An object of the present invention is to provide an analog buffer and a method of driving an analog buffer having simplified configuration and reduced power consumption.

Another object of the present invention is to provide a liquid crystal display apparatus and a method of driving a liquid crystal display apparatus using an analog buffer having simplified configuration and reduced power configuration.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an analog buffer for buffering an input voltage to an output line comprises a constant current source to supply a constant current to the output line; and a comparator to compare a voltage charged on the output line with the input voltage to turn-off the constant current source if it is determined that the voltage charged on the output line corresponding to the input voltage is buffered to the output line.

In another aspect, a method of driving an analog buffer for buffering an input voltage to an output line comprises charging the output line using a constant current source; and turning-off the constant current source if it is determined that a voltage charged on the output line corresponds to the input voltage by comparing the input voltage with a voltage on the output line that is fed back through a comparator.

In another aspect, an analog buffer for buffering an input voltage to an output line comprises means for supplying a constant current source to an output line; and means for comparing a voltage charged on the output line with an input voltage to turn-off the constant current source if it is determined that the voltage charged on the output line corresponding to the input voltage is buffered to the output line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawing. Hereinafter, the preferred embodiments of the present invention will be described in detail with reference to FIGS. 4 to 13.

Figure 4:
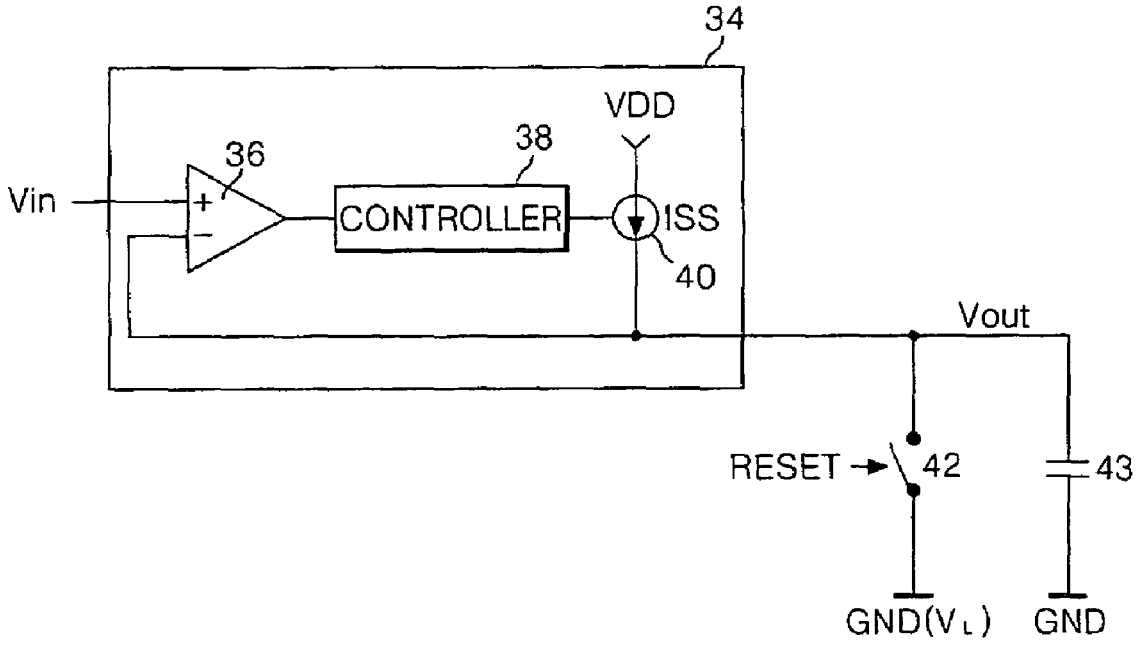
FIG. 4 is a schematic block diagram of an analog buffer according to an embodiment of the present invention.

FIG. 4 is a schematic block diagram of an analog buffer according to an embodiment of the present invention.

Referring to FIG. 4, an analog buffer 34 includes a comparator 36 to compare an input voltage Vin and an output voltage Vout, a constant current source 40 to supply a constant current ISS to charge a data line and a controller 38 to turn-on/turn-off the constant current source 40 depending on an output of the comparator 36.

First, a switch 42 connected in parallel to an output line, that is, a data line, of the analog buffer 34 is turned-on. Accordingly, the comparator 36 is initialized with a feedback voltage and the data line is initialized with a voltage supplied via the switch 42. Next, the switch 42 is turned-on to charge the data line. Also, the controller 38 turns-on the constant current source 40 so that the data line is charged via the constant current source 40. At this time, the comparator 36 feeds-back the output voltage Vout charged to the data line to be compared with the input voltage Vin. Sequentially, if the output voltage Vout identical to the input voltage Vin is charged in the data line, the comparator 36 turns-off the constant current source 40 by the controller 38.

Figure 5:
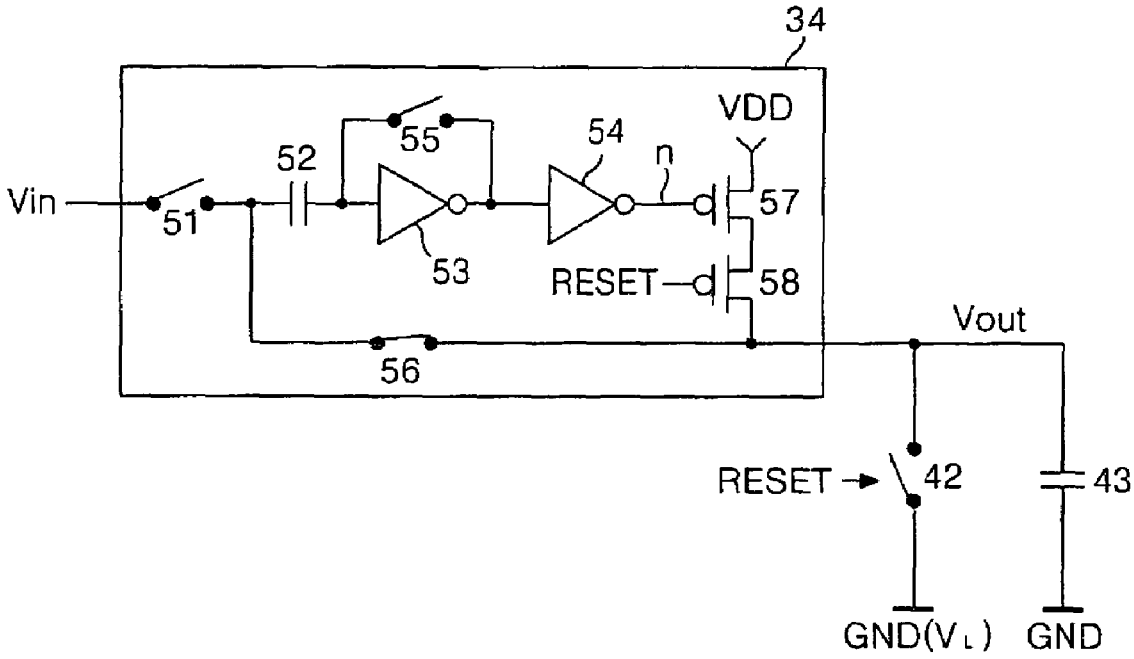
FIG. 5 is an exemplary detailed circuit diagram of the analog buffer shown in FIG. 4.

A detailed circuit diagram of the analog buffer 34 having the configuration as described is shown in FIG. 5.

Referring to FIG. 5, an analog buffer 34 according to a first embodiment includes a first inverter 53, a first capacitor 52 connected in series between an input line and the first inverter 53, a first switch 51 connected between the input line and the first capacitor 52, a second switch 55 connected between an input terminal and an output terminal of the first inverter 53 and a third switch 56 connected between the input line and the output line of the analog buffer 34 which are used as the comparator 36 shown in FIG. 4. In addition, the analog buffer 34 shown in FIG. 5 further includes a second inverter 54 used as the controller 38 shown in FIG. 4 and a fourth switch 57, used as the constant current source 40 in FIG. 4, to control a conductive path between a first supply line VDD and an output line of the analog buffer 34 in accordance with an output signal of the second inverter 54. Herein, the fourth switch 57 and a fifth switch 58 are implemented with PMOS transistors as shown in FIG. 5.

Figure 6A:
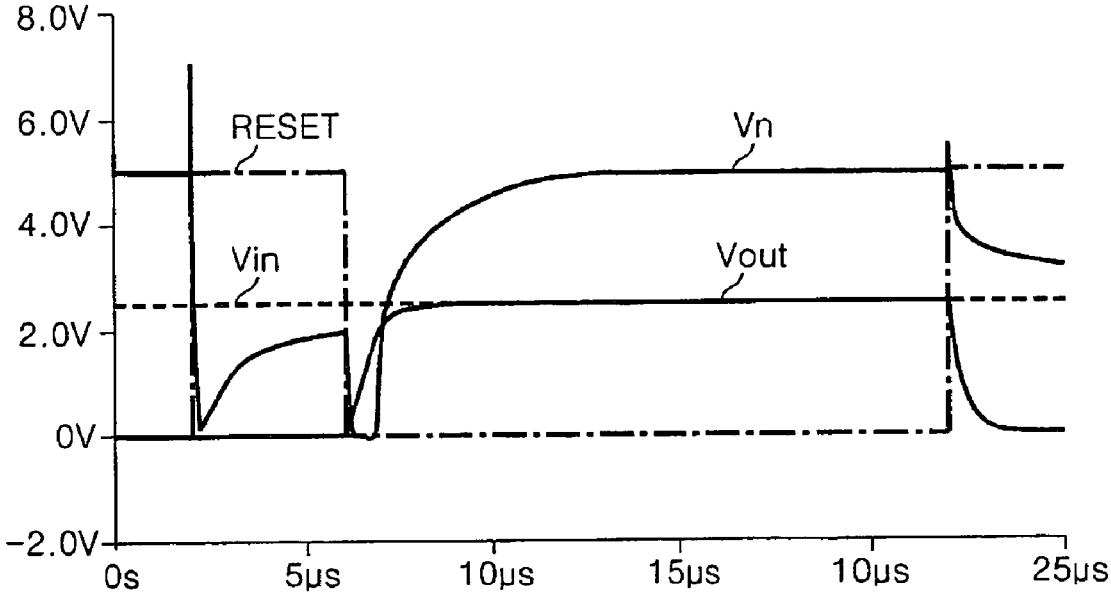
FIGS. 6A and 6B are a driving waveform diagram and a power consumption waveform diagram of the analog buffer shown in FIG. 5, respectively.

In FIG. 5, all of the first, the second, the third, the fifth and the sixth switches 51, 55, 56, 58 and 42 are controlled by a reset pulse RESET. Among these switches, the first, the second and the sixth switches 51, 55 and 42 operate contrary to the third and the fifth switches 56 and 58. First, for a reset period, by the reset pulse RESET, as shown in FIG. 6A, the first, the second and the sixth switches 51, 55 and 42 are turned-on while the third and the fifth switches 56 and 58 are turned-off. Accordingly, an input terminal and an output terminal of the first inverter 53 are shorted so that the first inverter 53 is initialized with an intermediate voltage Vm, which is a logic threshold voltage, and the data line is initialized with a second supply voltage. The second supply voltage includes a ground voltage GND or a voltage $V_L$ lower than the input voltage Vin. Herein, the voltage $V_L$ uses the lowest voltage in the range of a gamma voltage in which the input voltage is included among gamma voltages having a variety of levels used to a digital-analog converter in a data driver. Also, for the reset period, the input voltage Vin is supplied to the first capacitor 52 via the first switch 51 so that the first capacitor 52 is charged by a difference voltage of the input voltage Vin and the intermediate voltage Vm. The fifth switch 58 turned-off for the reset period serves to prevent a collision of a voltage supplied via the fourth switch 57 and the second supply voltage GND or $V_L$ supplied to the data line via the sixth switch 42.

Next, for a data charging interval, the first, the second and the sixth switches 51, 55 and 42 are turned-off by the reset pulse RESET and the third and the fifth switches 56 and 58 are turned-on by the reset pulse RESET. Accordingly, an output voltage, being charged in the data line via the fourth and the fifth switch 57 and 58 from a supply line of the first supply voltage VDD becomes the feedback to the comparator 36 and then is compared with the input voltage Vin in the comparator 36 having the first inverter 53. In this case, as shown in FIG. 6A, if the output voltage Vout charged in the data line is lower than the input voltage Vin, then the first inverter 53 outputs a high logic voltage and the second inverter 54 outputs a low logic voltage Vn contrary to the first inverter 53, thereby enabling the fourth switch 57 to supply the first supply voltage VDD. Moreover, if the output voltage Vout on the data line becomes identical to the input voltage Vin as shown in FIG. 6A, the first inverter 53 outputs a low logic voltage and the second inverter 54 outputs a high logic voltage Vn contrary to the first inverter 53, thereby turning-off the fourth switch 57.

Figure 6B:
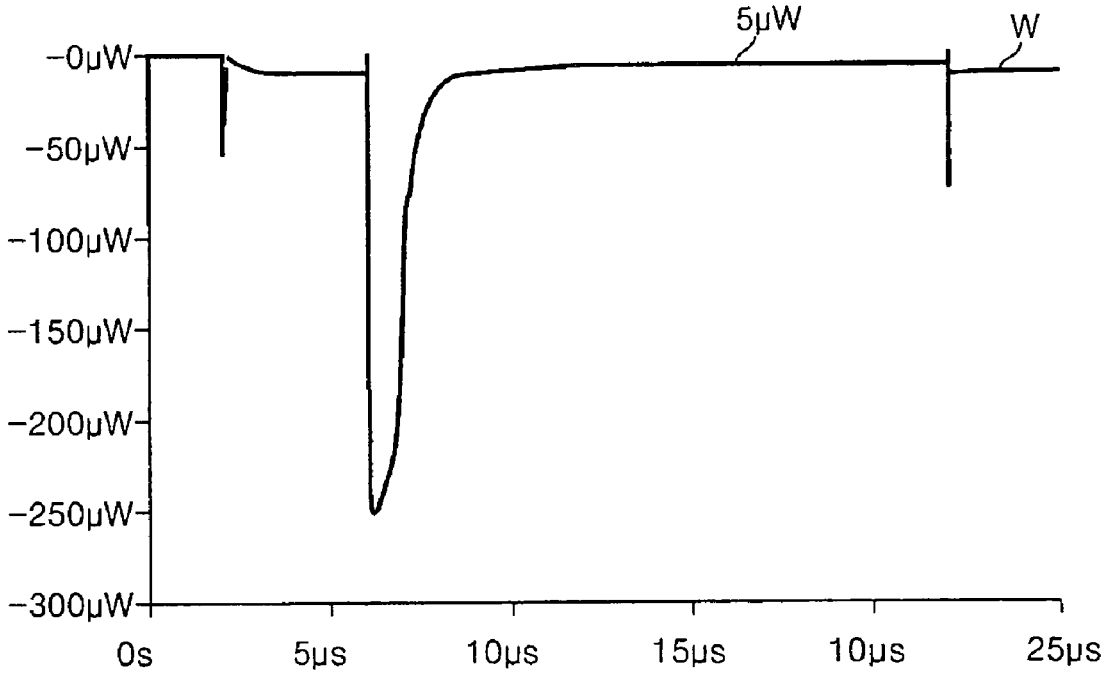

Thus, in the analog buffer 34 according to the first embodiment of the present invention, if it is completed that the output voltage Vout corresponding to the input voltage Vin is charged in the data line, then a constant current path is cut-off, which results in a power consumption reduction. Referring to FIG. 6B, after completing the charge of the output voltage Vout corresponding to the input voltage Vin in the data line, it can be recognized that the power consumption in the analog buffer 34 shown in FIG. 5 is remarkably reduced to a level of about 5 μW (microwatts).

Figure 1:
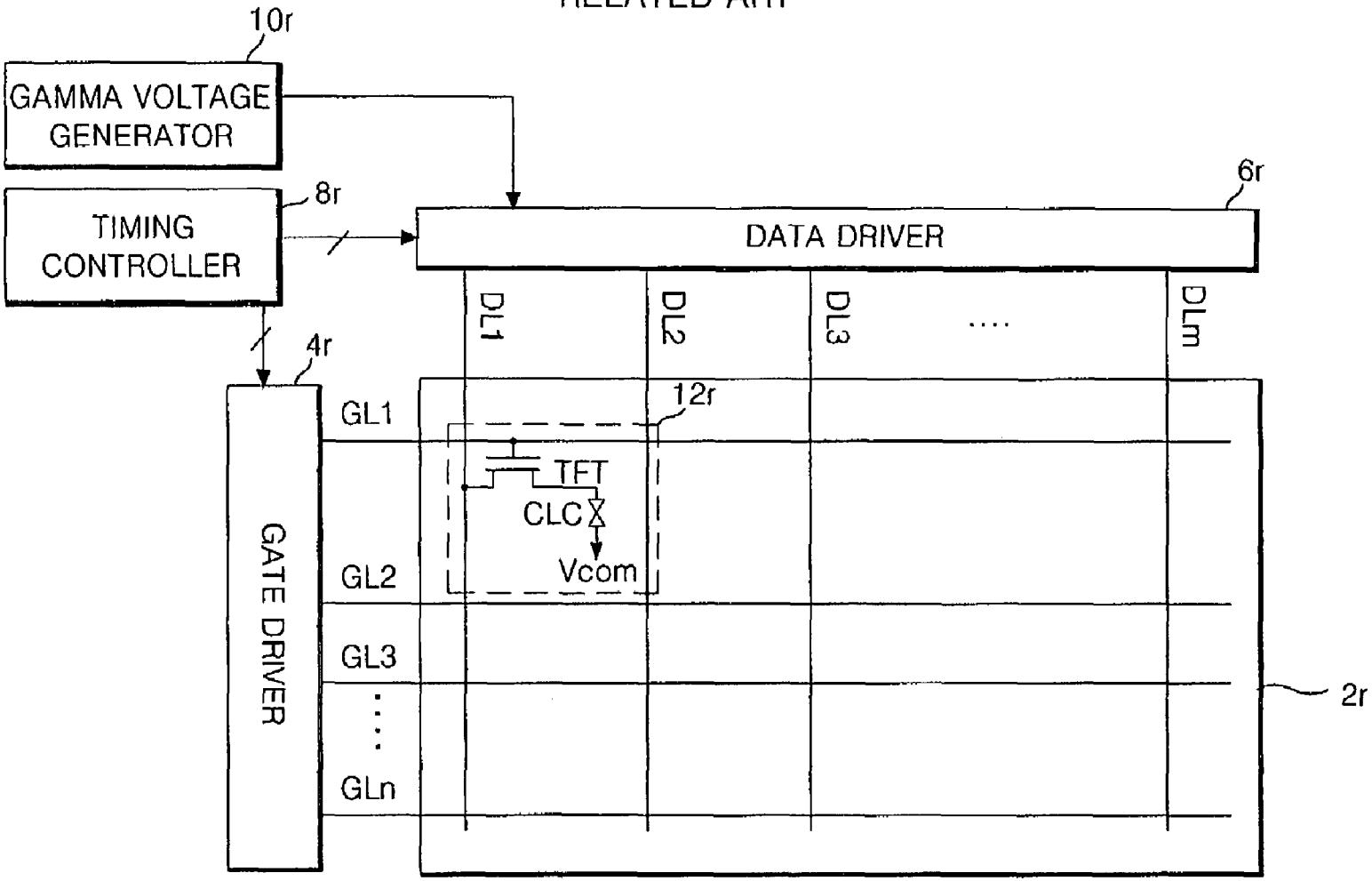
FIG. 1 RELATED ART
FIG. 1 is a schematic block diagram showing a related art liquid crystal display device.
Figure 2:
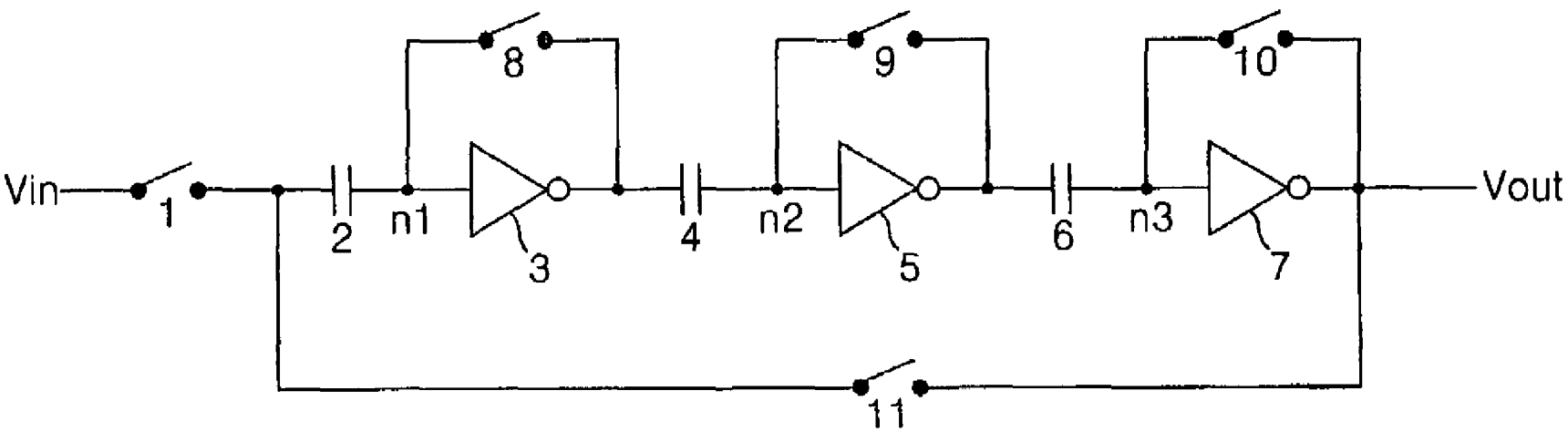
FIG. 2 RELATED ART
FIG. 2 is a circuit diagram illustrating a related art analog buffer.
Figure 3A:
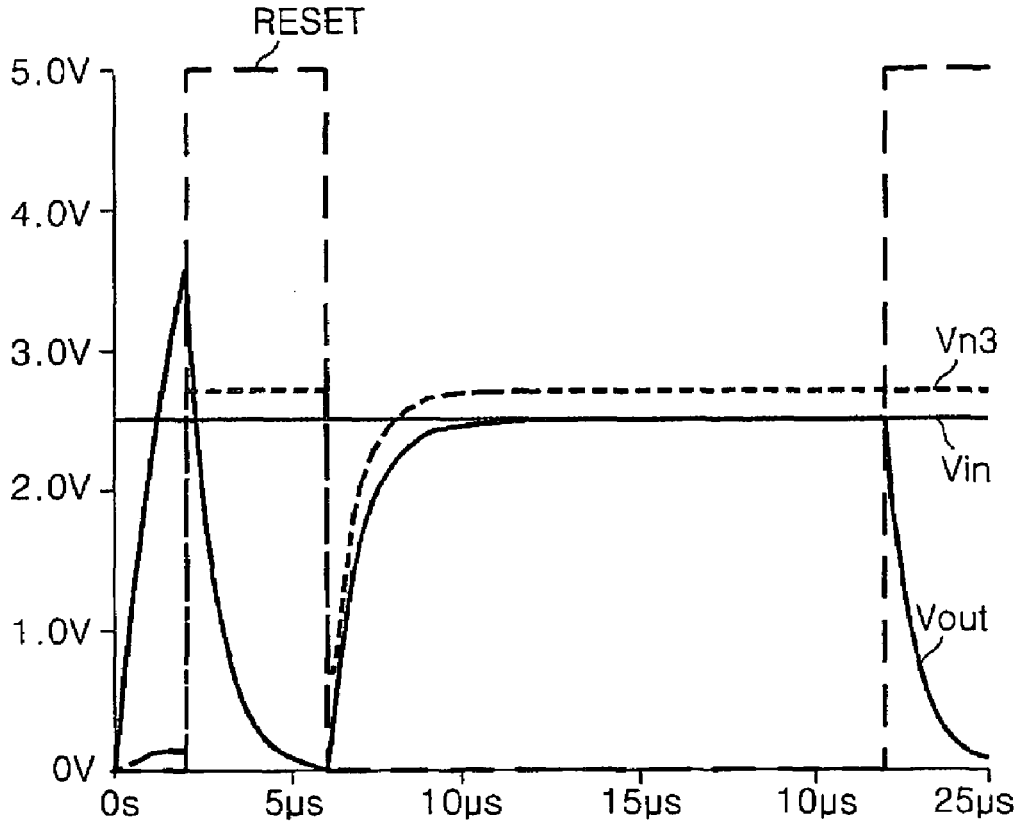
FIG.3A RELATED ART
FIGS. 3A and 3B are a driving waveform diagram and a power consumption waveform diagram of the analog buffer shown in FIG. 2, respectively.
Figure 3B:
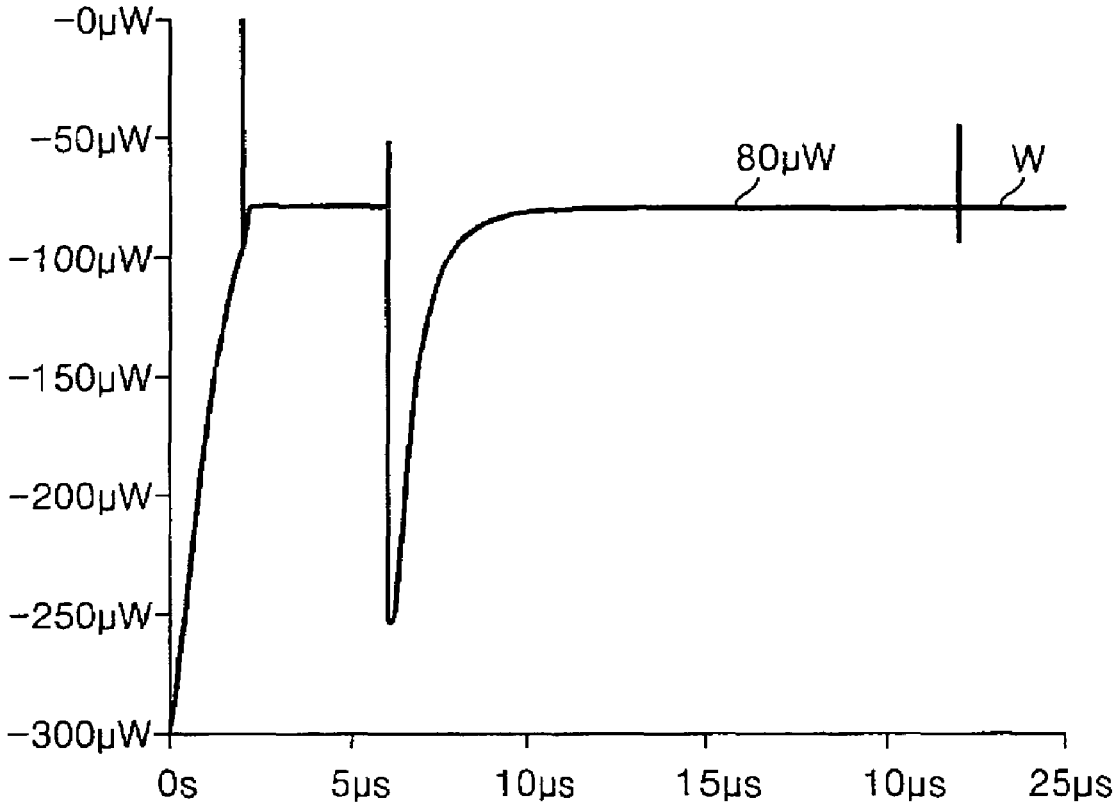
FIG.3B RELATED ART

Also, the related art analog buffer shown in FIG. 2 uses odd-number of inverters, e.g., three inverters with three capacitors. While the analog buffer 34 shown in FIG. 5 uses even-number of inverters, e.g., two inverters with one capacitor, thereby enabling the simplification of the circuit for the analog buffer 34.

Figure 7:
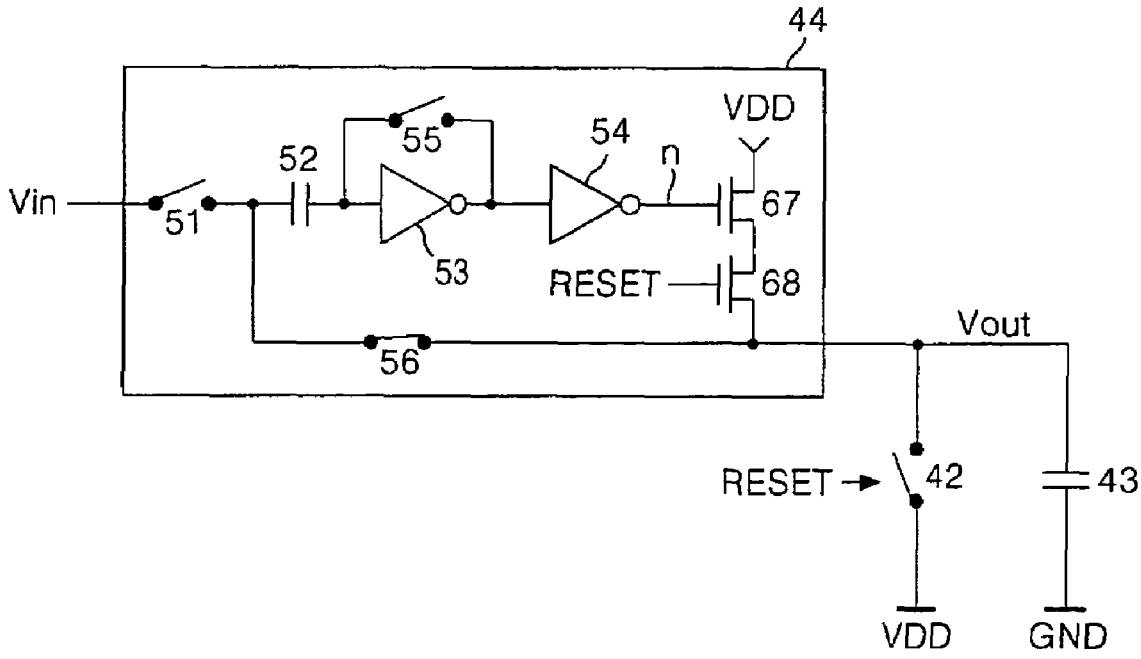
FIG. 7 is a detailed block diagram of an analog buffer according to a second embodiment of the present invention.

FIG. 7 shows a detailed circuit diagram of an analog buffer according to a second embodiment of the present invention. Referring to FIG. 7, an analog buffer 44 according to the second embodiment of the present invention has a configuration of elements similar to those of the analog buffer 34 shown in FIG. 5 except that a fourth and a fifth switch 67 and 68 forming the conductive path between a supply line and an output line of a first supply voltage GND is implemented with NMOS transistors. Therefore, a detailed explanation of the elements similar to those of the analog buffer in FIG. 5 will be omitted for the sake of simplicity.

Meanwhile, in FIG. 7, a first supply voltage uses a ground voltage GND and a second supply voltage uses a VDD and a voltage $V_H$ higher than an input voltage Vin. Herein, the voltage $V_H$, which is higher than the input voltage Vin, uses a highest voltage in the range of a gamma voltage in which the input voltage is included among gamma voltages having a variety levels used to a digital-analog converter in a data driver.

Figure 8A:
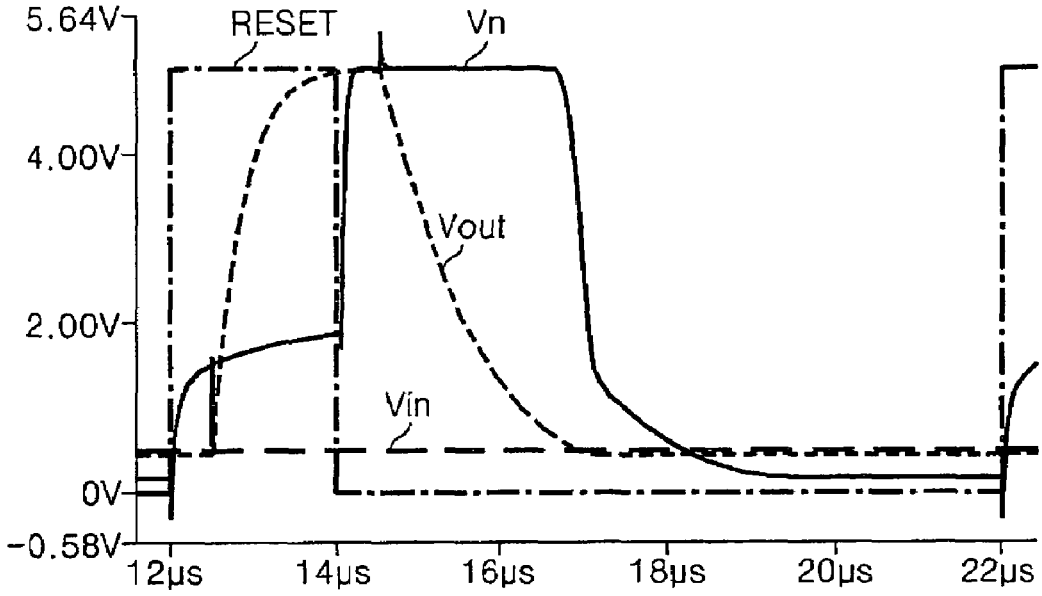
FIGS. 8A and 8B are a driving waveform diagram and a power consumption waveform diagram of the analog buffer shown in FIG. 7, respectively.

First, for a reset interval, by the reset pulse RESET as shown in FIG. 8A, the first, the second and the sixth switches 51, 55 and 42 are turned-on, and the third and the fifth switch 56 and 58 are turned-off. Accordingly, an input terminal and an output terminal of the first inverter 53 are shorted so that the first inverter 53 is initialized to a level of an intermediate voltage Vm, which is a logic threshold voltage, and the data line is initialized to a level of a second supply voltage VDD or $V_H$. Also, for the reset interval, the input voltage Vin is supplied via the first switch 51 so that the first capacitor 52 is charged by a difference voltage of the input voltage Vin and the intermediate voltage Vm.

Next, for a data charging interval, the first, the second and the sixth switches 51, 55 and 42 are turned-off by the reset pulse RESET and the third and the fifth switch 56 and 58 are turned-on by the reset pulse RESET. Accordingly, as shown in FIG. 8, an output voltage Vout on the date line supplied via the fourth and the fifth switches 57 and 58 is discharged toward the first supply voltage GND. The discharged output voltage Vout on the data line becomes the feedback to the comparator 36 and then is compared with the input voltage Vin in the comparator 36 having the first inverter 53. In this case, if the output voltage Vout on the data line is higher than the input voltage Vin, the first inverter 53 outputs a low logic voltage and the second inverter 54 outputs a high logic voltage Vn contrary to the first inverter 53, thereby enabling the fourth switch 67 to discharge the output voltage Vout on the data line as the first supply voltage GND. Moreover, if the output voltage Vout on the data line becomes identical to the input voltage Vin as shown in FIG. 8*a* as time elapses, then the first inverter 53 outputs a high logic voltage and the second inverter 54 outputs a low logic voltage Vn contrary to the first inverter 53, thereby turning-off the fourth switch 67.

Figure 8B:
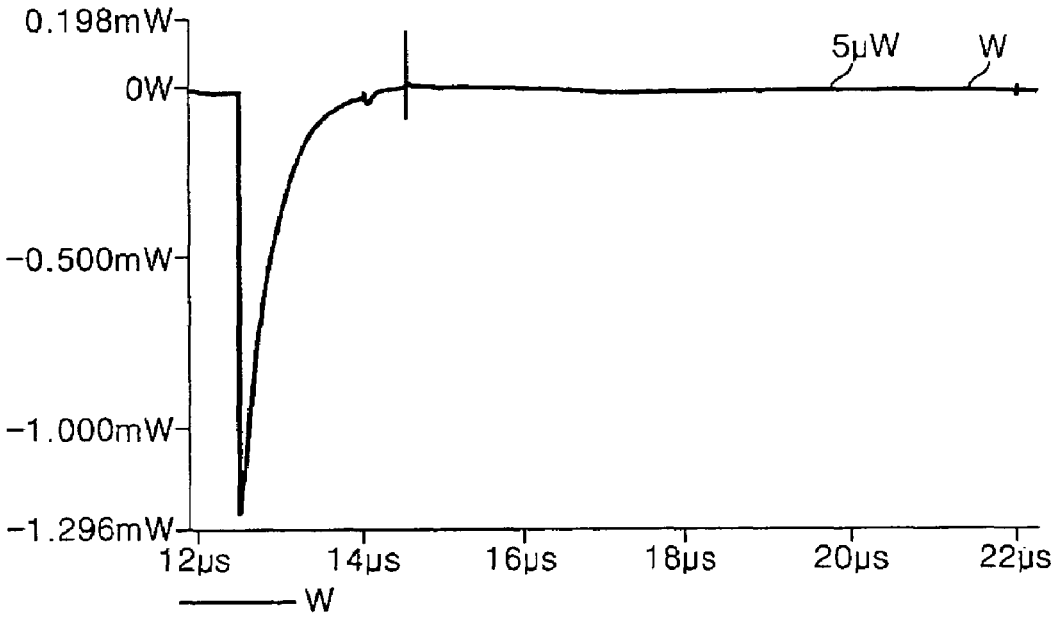

Thus, in the analog buffer 44 according to the second embodiment of the present invention, if the output voltage Vout on the data line becomes identical to the input voltage Vin, then a constant current path is cut-off. Accordingly, the power consumption in the analog buffer is reduced. Referring to FIG. 8B, if the output voltage Vout on the data line becomes identical to the input voltage Vin in the analog buffer shown in FIG. 7, it can be recognized that the power consumption in the analog buffer is remarkably reduced to a level of about 5 μW (microwatts).

Also, the related art analog buffer shown in FIG. 2 uses an odd-number of inverters, e.g., three inverters with three capacitors. While the analog buffer 44 shown in FIG. 7 uses an even-number of elements, e.g., two inverters with a capacitor, thereby simplifying the circuit configuration of the analog buffer.

Figure 9:
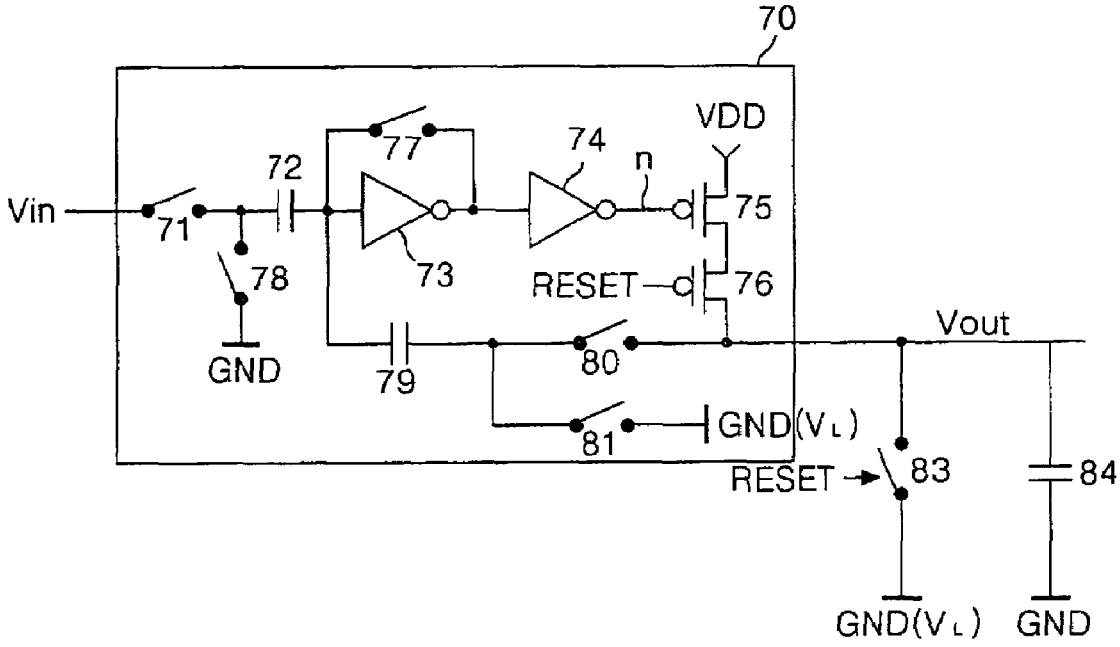
FIG. 9 is a detailed block diagram of an analog buffer according to a third embodiment of the present invention.

FIG. 9 shows a detailed circuit diagram of an analog buffer according to a third embodiment of the present invention.

Referring to FIG. 9, an analog buffer 70 according to a third embodiment of the present invention further includes a second capacitor 79 connected in series to a feedback line through a third switch 80; a seventh switch 78 connected between an input terminal of a first capacitor 72 and an input line of a second supply voltage GND or $V_L$; and an eighth switch 81 connected between a node between the second capacitor 79 and the third switch 80 and a line of the second supply voltage GND or $V_L$. Herein, the feedback line is connected to a node between the first capacitor 72 and an input terminal of the first inverter 73.

In FIG. 9, a first, a second, a third, a fifth, a sixth, a seventh and a eighth switches 71, 77, 80, 76, 83, 78 and 81 are controlled by a reset pulse RESET. Among these switches, the first, the second, the sixth switch and the eighth switched 71, 77, 83 and 81 operate contrary to the third and the fifth switches 56 and 58.

Figure 10A:
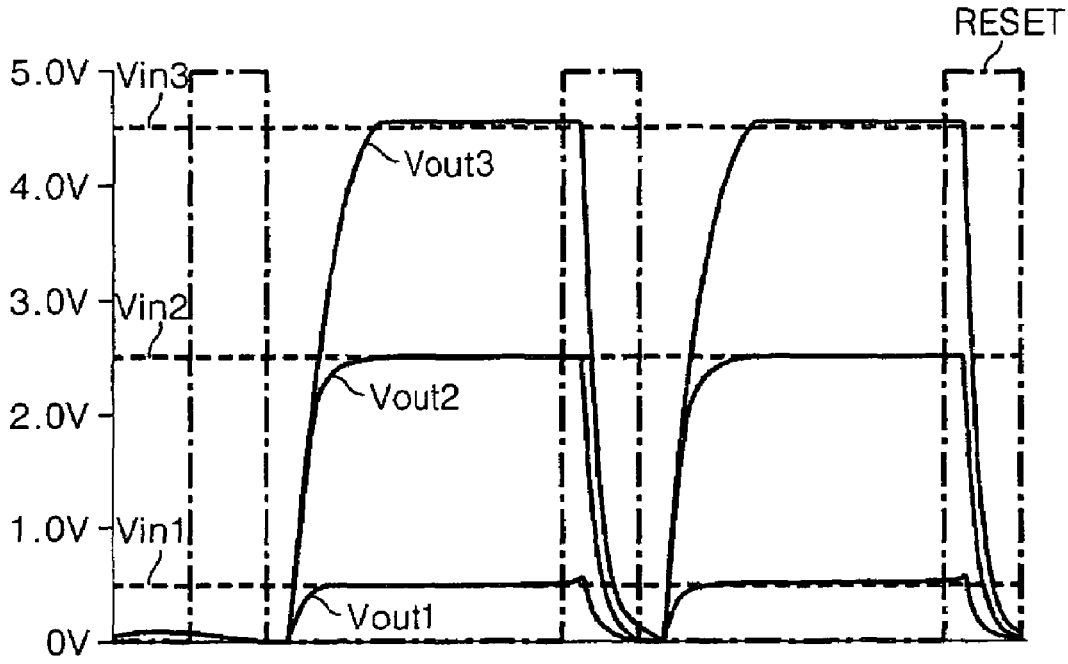
FIGS. 10A and 10B are a driving waveform diagram and a power consumption waveform diagram of the analog buffer shown in FIG. 9, respectively.

First, for a reset interval, the first, the second, the sixth and the eighth switches 71, 77, 83 and 81 are turned-on by the reset pulse RESET as shown in FIG. 10A, and the third, the fifth and the seventh switch 80, 76 and 78 are turned-off by the reset pulse RESET as shown in FIG. 10A. Accordingly, a voltage feedback through the sixth switch 83 and a voltage on the data line are initialized to the level of the second supply voltage. At this time, an input terminal and an output terminal of the first inverter 73 are shorted so that the first inverter 73 is initialized to a level of an intermediate voltage Vm, which is a logic threshold voltage. Accordingly, an offset voltage of the first inverter 73, that is, a difference voltage of an input voltage Vin and the intermediate voltage Vm is charged in the first and the second capacitor 72 and 79. Herein, the second capacitor 79 allows a stable operation of the analog buffer by minimizing an oscillation of the output voltage Vout. The second supply voltage uses a ground voltage GND or a voltage $V_L$ which is lower than the input voltage Vin. Herein, the voltage $V_L$ uses the lowest voltage in the range of a gamma voltage in which the input voltage is included, among gamma voltages having a variety of levels used to a digital-analog converter in a data driver. The fifth switch 76 turned-off for the reset interval serves to prevent the collision of a voltage supplied via the fourth switch 75 and the second supply voltage GND or $V_L$ supplied to the data line via the sixth switch 83.

Next, for a data charging interval, the first, the second, the sixth switch and the eight switches 71, 77, 83 and 81 are turned-off by the reset pulse RESET and the third, the fifth and the seventh switch 80, 76 and 78 are turned-on by the reset pulse RESET. Accordingly, an output voltage Vout, which is charged in the data line via the fourth and the fifth switches 75 and 76 from a supply line of the first supply voltage VDD becomes feedback to the comparator 73 and then is compared with the input voltage Vin in the comparator 73. In this case, if the output voltage Vout charged in the data line is lower than the input voltage Vin, then the first inverter 73 outputs a high logic voltage and the second inverter 74 outputs a low logic voltage Vn contrary to the first inverter 73, thereby enabling the fourth switch 75 to supply the first supply voltage VDD. Moreover, if the output voltage Vout on the data line becomes identical to the input voltage Vin as time elapses, the first inverter 73 outputs a low logic voltage and the second inverter 74 outputs a high logic voltage contrary to the first inverter 73, thereby turning-off the fourth switch 75.

Figure 10B:
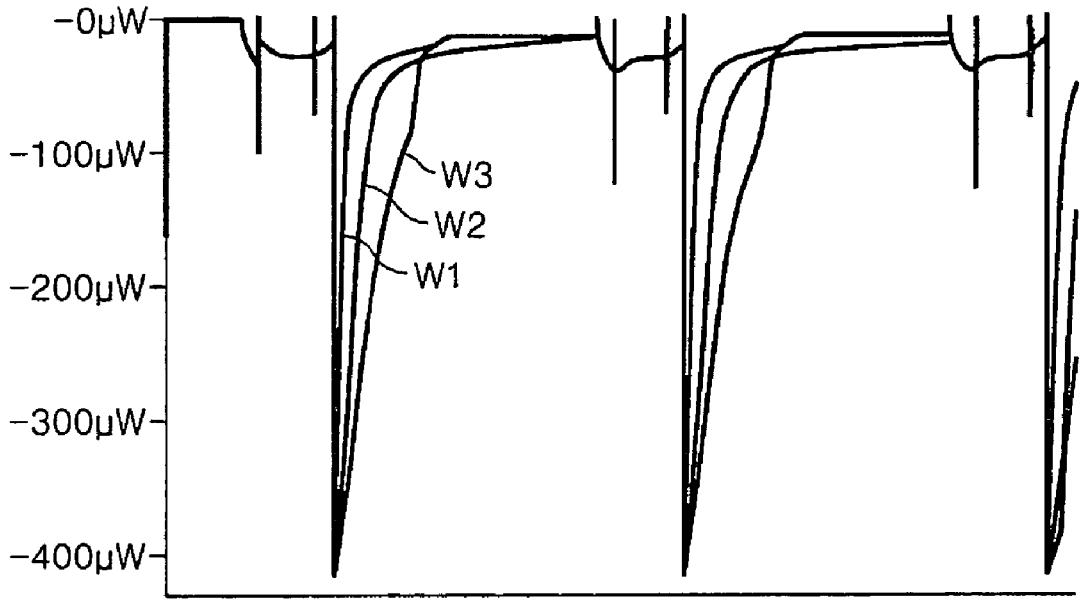

Thus, in the analog buffer 70 according to the third embodiment of the present invention, if it is completed that the output voltage Vout corresponding to the input voltage Vin is charged in the data line, then a constant current path is cut-off. In other words, in the analog buffer 70 according to the third embodiment of the present invention, if each of the output voltages Vout1, Vout2 and Vout3 corresponding to each of the input voltages Vin1, Vin2 and Vin3 is charged in the data line as shown in FIG. 10A, then the constant current path is cut-off. As a result, a power consumption in the analog buffer is reduced. Referring to FIG. 10B, after completing the charge of the output voltage Vout corresponding to the input voltage Vin in the data line, it can be recognized the power consumption in the analog buffer 70 shown in FIG. 9 supplying the first supply voltage VDD is remarkably reduced.

Also, the related art analog buffer shown in FIG. 2 uses odd-number of inveters, e.g., three inverters with three capacitors. While the analog buffer 70 shown in FIG. 9 uses even-number of inverters, e.g., two inverters with one capacitor, thereby simplifying a circuit constitution of the analog buffer.

Moreover, in the analog buffer 70 shown in FIG. 9, it is possible to adjust the output voltage by modulating a ratio, C2/C1, of capacitances C1 and C2 of first and second capacitors 72 and 79 is adjusted. In other words, the output voltage can be adjusted by modulating the capacitance ratio C2/C1 of the first capacitor 72 on the input line of the first inverter 73 and the second capacitor 79 on the feedback line of the first inverter 73. For instance, to modulate the capacitance ratio, such a scheme may be suggested that a plurality of capacitors is connected to the first capacitor 72 in parallel, and all of the capacitors are connected in parallel to the input line receiving the input voltage Vin via a plurality of switches. In this scheme, the capacitance on the input line of the first inverter 73 is modulated by selectively turning-on the switches so that the output voltage can be adjusted. Herein, when the switches are controlled by digital data, the output voltage can be adjusted in accordance with the digital data. Accordingly, the analog buffer 70 according to the third embodiment of the present invention can also be functioned as a digital-analog convert (DAC). For instance, the analog buffer 70 shown in FIG. 9 with the DAC function is incorporated in the data driver, the analog buffer 70 performs the DAC function along with a main DAC included in the data driver. In this case, the main DAC functions to convert most significant bits among pixel data into an analog signal, and the analog buffer with the DAC function functions to convert lowest significant bits among pixel data into an analog signal. In this case, the first and the second supply voltages supplied to the analog buffer use an adjacent two voltage levels among a variety of voltage levels divided by the most significant bit. Herein, voltages subdivided by the lowest significant bits are included between the adjacent two voltage levels.

Figure 11:
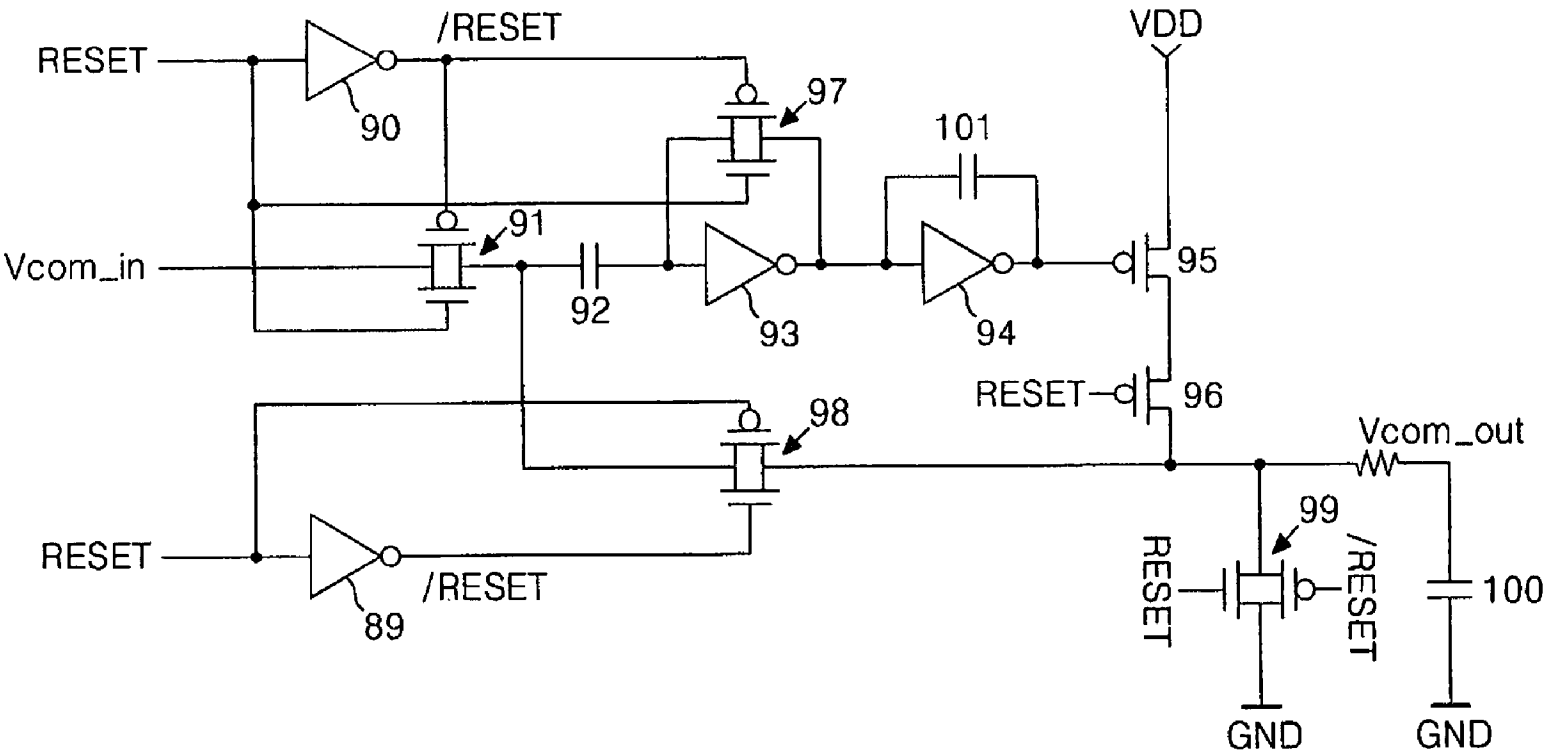
FIG. 11 is a detailed block diagram of an analog buffer according to a fourth embodiment of the present invention.

FIG. 11 shows a detailed circuit diagram of an analog buffer according to a fourth embodiment of the present invention. The analog buffer shown in FIG. 11 is applied to an output terminal of a common voltage generator to generate a common voltage Vcom, which is used as a reference voltage, at the time of driving a liquid crystal cell in a liquid crystal display device.

The analog buffer serving as a comparator shown in FIG. 11 includes: a first inverter 93; a first capacitor 92 serially connected between an input line of common voltage Vcom_in and the first inverter 93; a first switch 91 connected between the input line of common voltage Vcom_in and the first capacitor 92; a second switch 97 connected between the input terminal and the output terminal of the first inverter 93; and a switch connected between the output line of the analog buffer and an input line to feedback the output voltage Vcom_out. In addition, the analog buffer serving as a controller includes a second inverter 94 to invert the output signal of the first inverter 93, a second capacitor 101 connected between the input terminal and the output terminal of the second inverter 94. The analog buffer serving as a constant current source includes a fourth switch 95 to control a conductive path between a supply line of a first supply voltage VDD and an output line of the analog buffer in accordance with the output signal of the second inverter 94. The analog buffer further includes a fifth switch 96 connected between the fourth switch 95 and the output line of the analog buffer. Herein, the fourth and the fifth switches 95 and 96 are implemented with PMOS transistors. The output line of the analog buffer is connected to a common electrode of a liquid crystal capacitor 100. A sixth switch 99 for initializing the common electrode is connected to the output line in parallel.

In FIG. 11, the first, the second, the third, the fifth and the sixth switches 91, 97, 98, 96 and 99 are controlled by a reset pulse RESET. Among these switches, the first, the second and the sixth switches 91, 97 and 99 are implemented with a CMOS transistors which includes a NMOS transistor controlled by a reset pulse RESET and a PMOS transistor controlled by an inverted reset pulse /RESET through the third and the fourth inverters 89 and 90, the NMOS and the PMOS being connected in parallel. The third switch 98 is implemented with a CMOS transistor which includes a NMOS transistor controlled by a inverted reset pulse /RESET and a PMOS transistor controlled by a reset pulse RESET, inversely as in the switches 91, 97, 96 and 99, the NMOS and the PMOS being connected in parallel. The fifth switch 96 is operated along with the third switch 98 by being controlled by the reset pulse RESET.

Figure 12A:
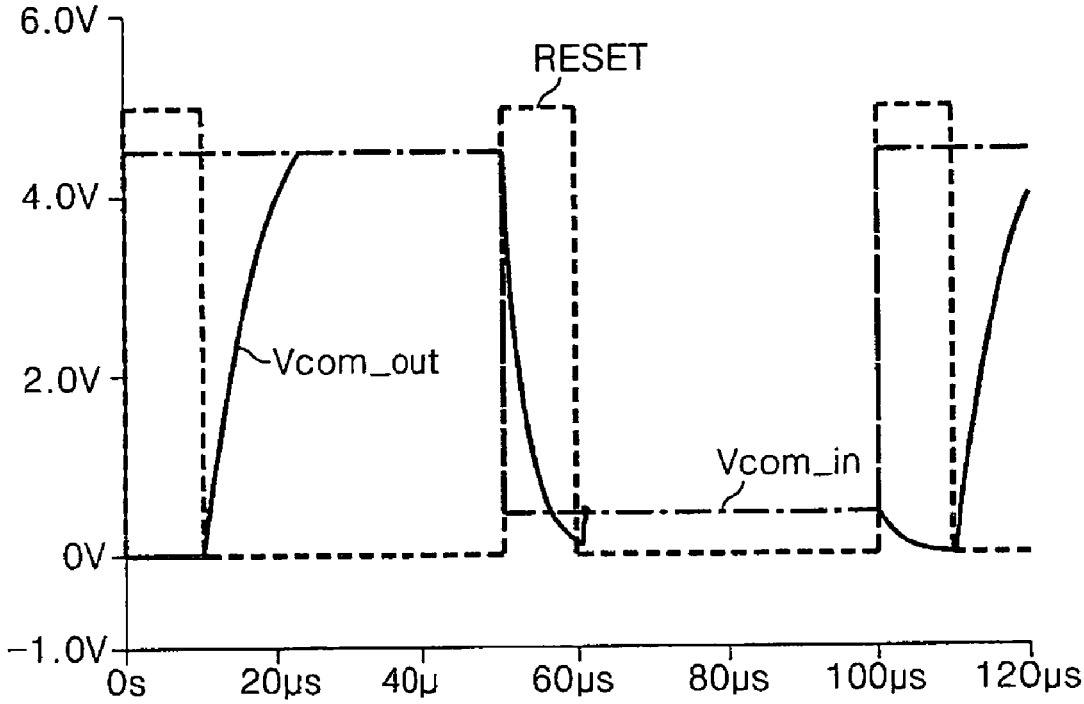
FIGS. 12A and 12B are a driving waveform diagram and a power consumption waveform diagram of the analog buffer shown in FIG. 11, respectively.

First, for a reset interval, the first, the second and the sixth switch 91, 97 and 99 are turned-on by the reset pulse RESET as shown in FIG. 12A, and the third and the fifth switch 98 and 96 are turned-off by the reset pulse RESET as shown in FIG. 12A. Accordingly, an input terminal and an output terminal of the first inverter 93 are shorted, so that the first inverter 93 is initialized to a level of an intermediate voltage Vm, which is a logic threshold voltage, and the data line is initialized to a level of a second supply voltage. The second supply voltage uses a ground voltage GND which is lower than an input common voltage Vcom_in. Also, for reset interval, the input common voltage Vcom_in is supplied via the first switch 91 so that the first capacitor 92 is charged by a difference voltage of the input common voltage Vcom_in and the intermediate voltage Vm. The fifth switch 96 turned-off in this reset interval serves to prevent the collision of a voltage supplied via the fourth switch 75 and the second supply voltage GND supplied to the common line via the sixth switch 99.

Next, for a common voltage charging interval, the first, the second and the sixth switches 91, 97 and 99 are turned-off by the reset pulse RESET, and the third and the fifth switches 98 and 96 are turned-on by the reset pulse RESET. Accordingly, an output voltage Vcom_out, which is charged to the data line via the fourth and the fifth switches 95 and 96 from a supply line of the first supply voltage VDD, becomes the feedback to the comparator and then is compared with the input common voltage Vcom_in the comparator. In this case, if the output voltage Vcom_out charged in the data line is lower than the input common voltage Vcom_in as shown in FIG. 12A, then the first inverter 93 outputs a high logic voltage and the second inverter 54 outputs a low logic voltage contrary to the first inverter 93, thereby enabling the fourth switch 95 to supply the first supply voltage VDD. Moreover, if the output voltage Vcom_out of the data line becomes identical to the input common voltage Vcom_in as shown in FIG. 12*a,* the first inverter 93 outputs a low logic voltage and the second inverter 94 outputs a high logic voltage contrary to the first inverter 93, thereby turning-off the fourth switch 95.

Figure 12B:
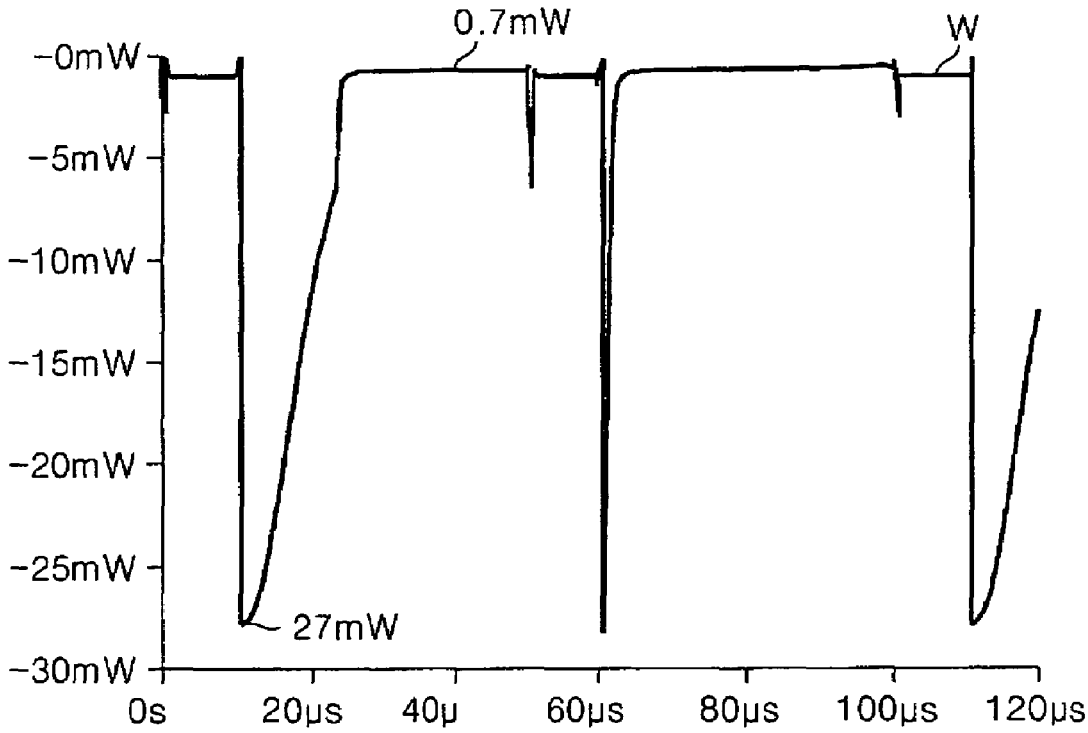

Thus, the analog buffer according to the present invention, if it is completed that the output voltage Vcom_out corresponding to the input voltage Vcom_in is charged in the common electrode, then a constant current path is cut-off, which results in reducing the power consumption. Referring to FIG. 12B, after completing the charge of the output voltage Vcom_out corresponding to the input voltage Vin in the common electrode, it can be recognized that the power consumption in the analog buffer 34 shown in FIG. 5 is remarkably reduced to a level of about 0.7 μW (microwatts).

Figure 13:
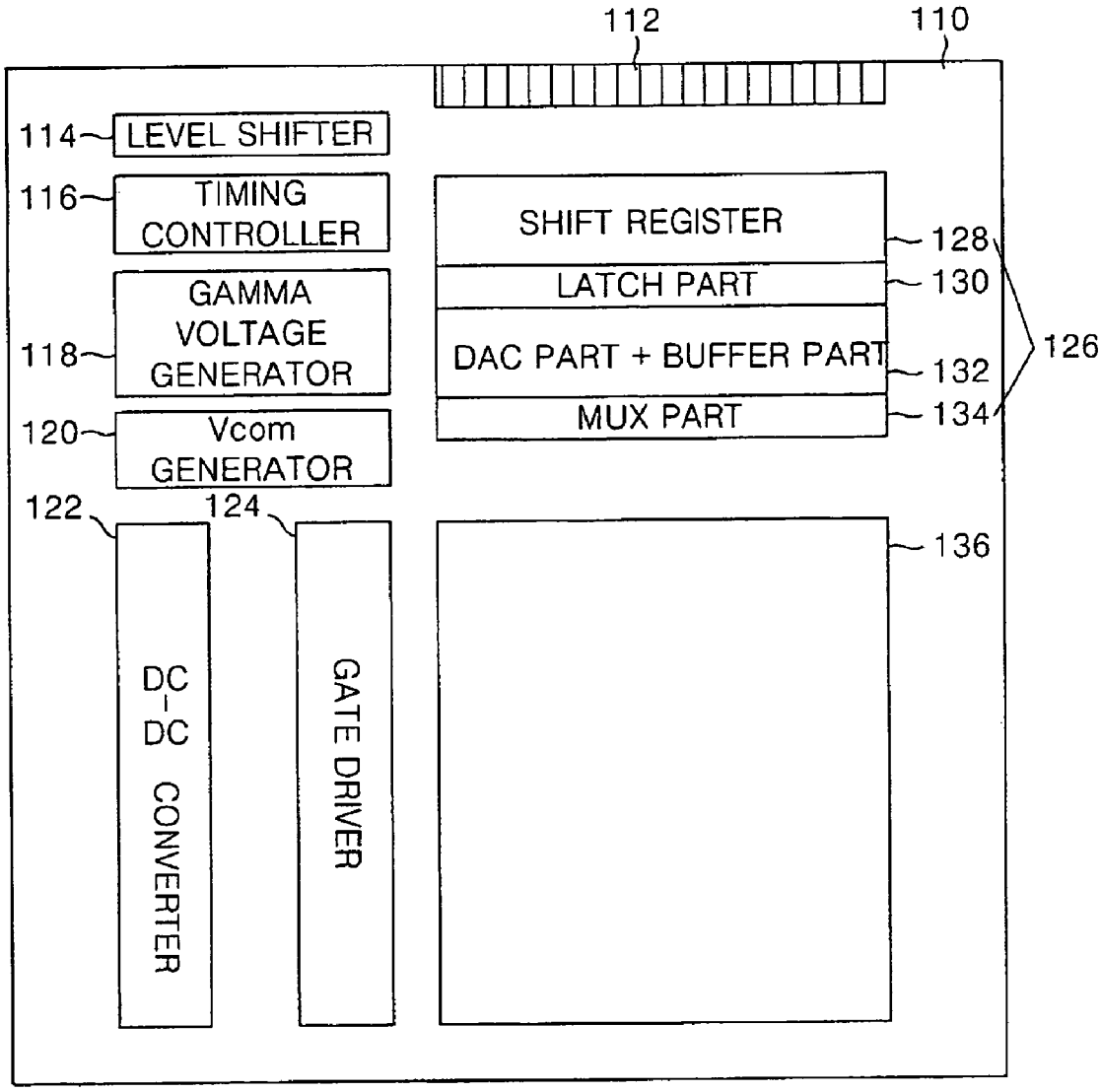
FIG. 13 is a schematic block diagram showing a liquid crystal display device having the analog buffer according to the present invention.

FIG. 13 illustrates a liquid crystal display apparatus having the analog buffer according to the present invention. As the liquid crystal display apparatus uses a material of poly silicons, a plurality of drive circuits used to drive a pixel matrix 136 is builted-in a liquid crystal panel in the liquid crystal display apparatus.

The liquid crystal display apparatus includes: a pixel matrix 136 defined by an intersection of a gate line and a data line; a gate driver 124 driving the gate line; a data driver 126 driving a data line; a timing controller 116 controlling the gate driver 124 and the data driver 126; a level shifter 114 level-shifting a driving signal provided from an external via a pad part 112; a gamma voltage generator 118 generating gamma voltages needed to the data driver 126; a common voltage generator 120 generating a common voltage to be supplied to a common electrode of the pixel matrix 136; and a DC-DC converter 122 generating a DC voltage necessary to the driving circuits.

The data driver 126 has a shift register 128 sequentially generating a sampling signal; a latch part 130 sampling and latching a pixel data from the timing controller 130 in response to the sampling signal, a digital-analog converter DAC portion 132, and a multiplexer MUX part 134 dividing the pixel signal from the DAC portion 132 into a plurality of data lines. The analog buffer of the present invention is applicable to the DAC portion 132 of the data driver 126 and the output end of the common voltage generator 120 among the driving circuits. Therefore, it is possible to reduce a power consumption and to minimize the distortion of the output signal.

As described above, the analog buffer according to the present invention uses even-number of inverters, e.g., two inverters with one or two capacitors, thereby simplifying a circuit for the analog buffer. Moreover, the analog buffer according to the present invention cuts-off a constant current path by comparing a feed-backed output voltage with an input voltage to detect the completion of charging the output voltage corresponding to the input voltage in a data line. As a result, a power consumption can be reduced remarkably. Furthermore, the analog buffer according to the present invention is applied to a data driver and a common voltage generator of a liquid crystal display apparatus, thereby reducing power consumption.

It will be apparent to those skilled in the art that various modifications and variations can be made in the analog buffer and driving method thereof, liquid crystal display apparatus using the same and driving method thereof of the present invention without departing from the spirit or scope of the invention. Thus, it is intended that the present invention cover the modifications and variations of this invention provided they come within the scope of the appended claims and their equivalents.

What is claimed is:

1. An analog buffer for buffering an input voltage to an output line, comprising:

a constant current source to supply a constant current to the output line; and a comparator to compare a voltage charged on the output line with the input voltage to turn-off the constant current source if it is determined that the voltage charged on the output line corresponding to the input voltage is buffered to the output line, wherein the comparator includes:

an inverter connected between an input line of the input voltage and the constant current source;

a capacitor connected in series between the input line and the inverter;

a first switch to switch the input voltage on the input line;

a second switch connected between an input terminal and an output terminal of the inverter; and a third switch connected between the input line and the output line, wherein the constant current source includes:

a fourth switch to provide a conductive path between a first supply voltage line and the output line;

a fifth switch to control a conductive path between the fourth switch and the output line; and a sixth switch connected in parallel to the output line, wherein the first, second and sixth switches operate contrary to the third and fifth switches.

2. The analog buffer of claim 1, further comprising a controller, connected between the comparator and the constant current source, to control a turn-on/turn-off of the constant current source in accordance with an output signal of the comparator.

3. The analog buffer of claim 2, wherein the controller includes a second inverter to invert the output signal of the inverter to control the constant current source.

4. The analog buffer of claim 3, further comprising a capacitor connected between an input terminal and an output terminal of the second inverter.

5. The analog buffer of claim 1, wherein the sixth switch initializes the output line to a second supply voltage level.

6. The analog buffer of claim 5, wherein the first, second, and sixth switches are turned-on, and the third and fifth switches are turned-off in accordance with a reset signal for a reset interval of the input voltage to initialize the comparator and the output line.

7. The analog buffer of claim 6, wherein the first, second and sixth switches are turned-off, and the third and fifth switches are turned-on in accordance with the reset signal for a charging interval of the input voltage so that a voltage corresponding to the input voltage is charged to the output line.

8. The analog buffer of claim 7, wherein each one of the first, second and third switches includes a first polarity transistor controlled by the reset signal and a second polarity transistor connected to the first polarity transistor in parallel and controlled by an inverted reset signal.

9. The analog buffer of claim 8, wherein the sixth switch includes a first polarity transistor controlled by the inverted reset signal and a second polarity transistor connected to the first polarity transistor in parallel and controlled by the reset signal.

10. The analog buffer of claim 5, further comprising:

a second capacitor connected in series with the feedback line;

a seventh switch connected between a node of the first switch and the capacitor and an input line of the second supply voltage; and an eighth switch connected between the second capacitor and the input line of the second supply voltage.

11. The analog buffer of claim 10, wherein the first, second, sixth and eighth switches are turned-on and the third, fifth and seventh switches are turned-off in accordance with a reset signal for a reset interval of the input voltage to initialize the comparator and the output line.

12. The analog buffer of claim 11, wherein the first, second, sixth and the eighth switches are turned-off, and the third, fifth and seventh switches are turned-on in accordance with the reset signal for a charging interval of the input voltage so that a voltage corresponding to the input voltage is buffered to the output line.

13. The analog buffer of claim 12, wherein a capacitance ratio of the capacitor and the second capacitor is modulated to adjust a voltage output through the output line.

14. The analog buffer of claim 1, wherein each of the fourth and fifth switches includes a PMOS transistor.

15. The analog buffer of claim 14, wherein the second supply voltage supplied to the sixth switch is a voltage lowered than a ground voltage or the input voltage, and a first supply voltage supplied to the fourth switch has a higher voltage level than the input voltage.

16. The analog buffer of claim 1, wherein each of the fourth and fifth switches includes a NMOS transistor.

17. The analog buffer of claim 16, wherein a voltage supplied to the fourth switch has a lower voltage level than the ground voltage or the input voltage, and a second supply voltage supplied has a higher voltage level than the input voltage.

18. A liquid crystal display apparatus using the analog buffer of claim 1, comprising:

a data driver to drive data lines of a pixel matrix;

a gate driver to drive gate lines of the pixel matrix; and a common voltage generator to supply a common voltage which is used as a reference voltage of the pixel matrix, wherein any one of the data driver, the gate driver and the common voltage generator includes the analog buffer.

* * * * *